United States Patent [19]

Nessi

[11] 4,289,012

[45] Sep. 15, 1981

[54] DEVICE FOR INSERTING AND PUSHING A BAR INTO A PRESS-PIERCING MILL

[75] Inventor: Aurindo Nessi, Albate (Como), Italy

[73] Assignee: Innocenti Santeustacchio S.p.A., Brescia, Italy

[21] Appl. No.: 964,273

[22] Filed: Nov. 28, 1978

[51] Int. Cl.[3] ..... B21B 17/06; B21B 25/02

[52] U.S. Cl. ..... 72/209; 72/250

[58] Field of Search ..... 72/250, 252, 209, 97; 414/744

[56] References Cited

U.S. PATENT DOCUMENTS 971,512 10/1910 Adams ..... 72/97

2,024,514 12/1935 Diescher ..... 72/97 X

*Primary Examiner*—Milton S. Mehr

*Attorney, Agent, or Firm*—George E. Kersey

[57] ABSTRACT

A device whereby a square bar is inserted and pushed into a press-piercing mill (PPM), the bar being disposed along the rolling and drilling axis of the mill, the apparatus being characterized in that it comprises:

a first thrust means (20) having a direction of action ($R_1$) and thrusting the bar (7) at a speed set for introducing the bar into the (PPM);

a second thrust means (14) having a direction of action (R) and thrusting the bar (7) at a speed set for rolling and simultaneously drilling the bar (7) in the (PPM), and an actuator (34) for simultaneously moving the first and second thrust means (20, 14) from a position in which the direction of action ($R_1$) coincides with PPM rolling axis (A) and the direction of action (R) is at a distance from the rolling axis (A) to a position in which the direction of action ($R_1$) is at a distance from the rolling axis (A) and the direction of action (R) coincides with the axis (A) and vice versa.

7 Claims, 4 Drawing Figures

DEVICE FOR INSERTING AND PUSHING A BAR INTO A PRESS-PIERCING MILL

BACKGROUND OF THE INVENTION

The invention relates to a device for inserting and pushing a square bar into a press-piercing mill, the bar being disposed along the drilling and rolling axis of the mill.

A press-piercing mill is a machine adapted to convert a hot square bar into a round, axially bored bloom. The machine, which hereinafter will be denoted by the abbreviation PPM, mainly comprises a mill comprising round-grooved rolls, a chuck mounted along the rolling and drilling axis of the rolling mill and extending from the outlet side of the mill, a bit secured to that end of the chuck which faces the mill, and a substantially tunnel inlet guide coaxial with the rolling and drilling axis and adapted to guide a square bar to the mill.

In order to convert a square bar into a round, axially bored bloom in a PPM, the bar must be held exactly along the rolling axis and pushed between the grooves in the rolls and against the drill bit.

It is known that, in order to meet the rolling and drilling requirements in optimum manner, the axial thrust exerted on the bar must be considerable, whereas the bar must move between the rolls at a constant, relatively low speed (e.g. an average of 0.4 m/sec.).

To this end, in the prior art, a high-power hydraulic or mechanical actuator is used and is capable of slowly moving a carriage which is guided in a direction parallel to the PPM rolling axis, the carriage bearing a thrust rod having a longitudinal axis coinciding with the rolling axis.

The carriage is movable, relative to the PPM, from a remote position in which a space for receiving a square bar is left between the free end of the thrust rod and the inlet of the PPM inlet guide, and a position which is near the mill inlet but does not obstruct it.

The distance travelled by the bar, between the time when it is positioned between the thrust rod and the PPM inlet guide and the time in which it is completely converted into a bored round bloom, can be divided into the following two portions:

1. The bar-insertion portion.

This is the portion travelled between the mouth of the inlet guide and the place where the bar makes contact with the rolls, and 2. The thrust portion.

This is the remaining portion, along which the bar undergoes the desired conversion into a corresponding axially bored round bloom.

Portions 1, 2 are both travelled through at a *reduced speed,* i.e. the set speed of operation of the actuator. Furthermore, when a new square bar is positioned along the rolling axis upstream of the inlet guide, it is necessary to wait until the slide, moving at the *reduced speed* of the actuator, has returned to the position remote from the PPM so as to leave space for receicing a bar between the thrust rod and the PPM inlet guide.

The result is that the productivity of the PPM is greatly reduced by idle times due to the low speed with which, in the piror art, the carriage travels through the insertion portion and its entire return to the position remote from the PPM, the only exception being the thrust portion, along which the reduced speed is imposed by recognized structural operational requirements of the PPM.

This is the main technical disadvantage in the prior art insertion and thrust devices for press-piercing mills. The disadvantage is even more noticeable when the PPM is used to produce round, axially bored blooms for a tube rolling mill operating at the rate of four or more work-pieces per minute.

SUMMARY OF THE INVENTION

The invention is based on the problem of providing a device for inserting and pushing a square bar into a PPM, the structural and functional properties of the device being such as substantially to reduce or eliminate the aforementioned technical disadvantages.

To this end, the device according to the invention comprises:

A first thrust means having a direction of action $R_1$ and thrusting the bar at a speed set for introducing the bar into the PPM;

A second thrust means having a direction of action R and thrusting the bar at a speed set for rolling and simultaneously drilling the bar in the PPM, and An actuator for simultaneously moving the first and second thrust means from a position in which the direction of action $R_1$ coincides with the PPM rolling axis A and the direction of action R is at a distance from the rolling axis A to a position in which the direction of action $R_1$ is at a distance from the rolling axis A and the direction of action R coincides with the axis A and vice versa.

According to a second feature of the invention, the directions of action R, $R_1$ of the thrust means are in the same plane and are in a predetermined spaced relationship.

According to a third feature of the invention, the first and the second thrust means are mounted on a plate movably guided by the actuator in a direction at an angle to the PPM rolling axis.

According to another feature of the invention, the plate is formed with a substantially cradleshaped seat extending coaxially with the direction of action $R_1$ and adapted to receive the bar when the direction $R_1$ is in the position remote from the PPM rolling axis.

Advantageously, one end of the plate is rotatable around a pivot having a vertical axis intersecting the rolling and drilling axis, whereas the other end of the plate is positioned near an inlet guide of the press-piercing mill, the directions of action of the first and second thrust means mounted on the plate being in the same plane as the rolling axis and intersecting at the point where the rolling axis intersects the vertical pivot axis.

BRIEF DESCRIPTION OF THE DRAWINGS

Other features and advantages of the invention will be clear from the following detailed description of a preferred but not exclusive embodiment of a device for inserting and pushing a square bar into a press-piercing mill, with reference to the accompanying non-limitative drawings in which.

DETAILED DESCRIPTION OF THE ILLUSTRATED EMBODIMENTS

Figure 2:
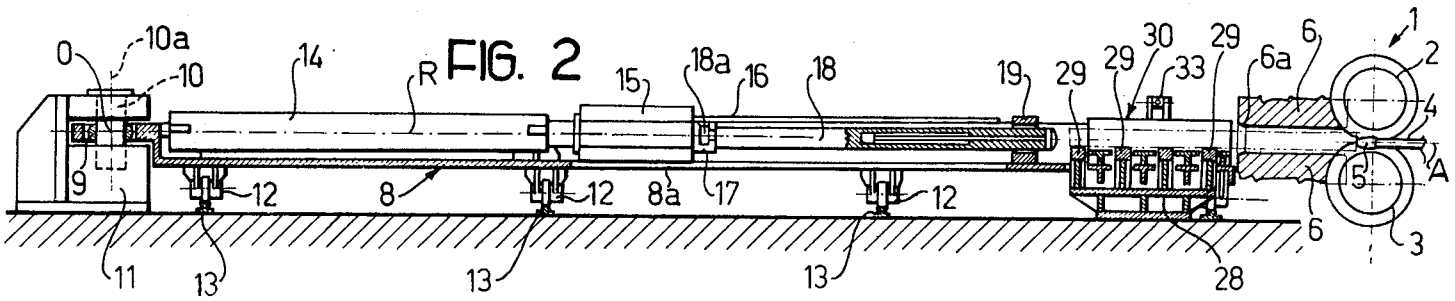
FIG. 2 is a cross-section along line II—II of FIG. 1.
Figure 1:
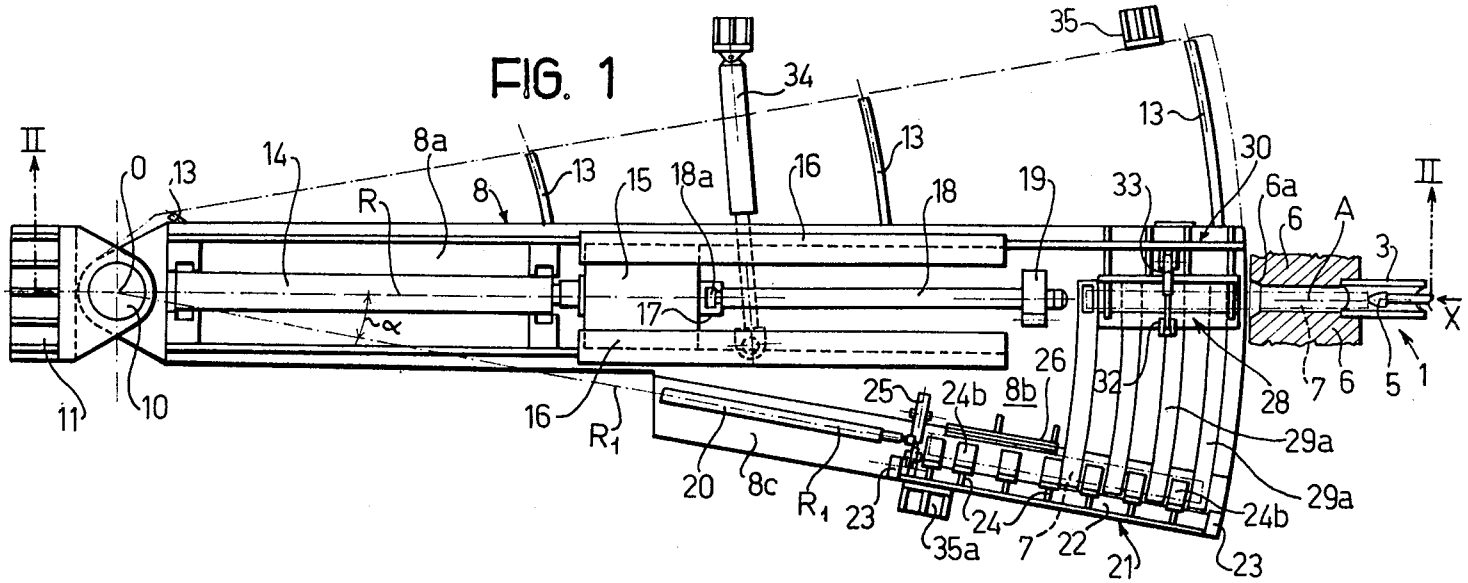
FIG. 1 is a plan view of a device according to the invention.

In the accompanying drawings, reference 1 denotes a press-piercing mill which, as is known, mainly comprises a mill 2, 3 having round-grooved rolls, a rod 4 extending along the rolling and drilling axis A and from the outlet side of the mill, the chuck bearing a piercing plug 5 at its end facing the mill, and a substantially tunnel inlet guide diagrammatically indicated at 6 and adapted to guide a square bar 7 to the mill in order to convert it into a round, axially bored bloom.

Reference 8 denotes a rigid horizontal oblong plate disposed upstream of the mouth 6*a* of the inlet guide 6 in the direction of motion of bar 7 through the PPM. The end of the plate remote from the PPM is rotatable, with interposition of a bearing 9, on a vertical pivot 10 borne by a structure 11 secured to the ground and forming an abutment, as will be clear from the subsequent description. The vertical axis 10*a* of the pivot 10 intersects the rolling and drilling axis A at the point O.

Under plate 8 there are a number of pairs of wheels 12 regularly spaced along the plate. Each pair engages and moves along a corresponding track 13. Tracks 13 form arcs of a circle and are concentric and have a common centre of curvature on the vertical axis 10*a* of pivot 10.

Plate 8, which can thus rotate around the vertical axis of pivot 10, mainly comprises a rectangular portion 8*a* having a preset length and a portion 8*b* substantially in the form of a sector of a circle having a given size and width and forming a lower lateral portion 8*c*.

A thrust means 14, e.g. an oleodynamic cylinder, is mounted in conventional manner on plate 8. The direction of action R of means 14 is horizontal and extends through the point of intersection O of the vertical axis of pivot 10 with the rolling and drilling axis A. Thrust means 14 acts axially on a carriage 15 which can reciprocate in horizontal guides 16, 16 formed by plate 8 and extending a predetermined length parallel to the direction of action R of the thrust means. Carriage 15 has a conventional hook-like holder 17 for removably engaging it with the end 18*a* of a thrust rod 18 which likewise extends coaxially with the direction of action R of thrust means 14. Rod 18, which is held and guided by a conventional annular holder 19 secured to plate 8, has a cross-section of a suitable shape and size for engaging and moving in the PPM inlet guide 6.

The thrust means 14 is constructed and dimensioned so as to subject carriage 15 to a strong thrust at the low speed of the carriage, the thrust and the speed being predetermined in accordance with recognized operating requirements when rolling and simultaneously drilling a bar 7 in the PPM.

A second thrust means 20, e.g. an oleodynamic cylinder, is mounted by conventional means (not shown) on plate 8, or, more specifically, at its lower portion 8*c*. The direction of action $R_1$ of means 20 is horizontal, extends through the point of intersection O between axia A and the vertical axis of pivot 10, and forms a constant predetermined angle $\alpha$ with direction R. Directions R, R' are in the same plane as axis A.

Thrust means 20 is designed and dimensioned so as to exert a weaker thrust at a considerably higher speed, compared with the set thrust and the set speed of which thrust means 14 is capable.

A tilting means bearing the general reference 21 is mounted on portion 8*c* of plate 8 at the side of thrust means 10. Means 21 is e.g. of the kind comprising a rotatably mounted pivot 22 of predetermined length having a longitudinal axis parallel to the direction $R_1$ of action of thrust means 20, a pair of bearings 23, 23 secured to the lower portion 8*c* of plate 8, and a number of levers 24 mounted on pivot 22 and projecting therefrom. The projecting portion of each lever 24 is L-shaped, comprising perpendicular webs 24*a*, 24*b* adapted to receive a square bar 7. Reference 25 diagrammatically indicates an actuator, e.g. a hydraulic cylinder, for rotating pivot 22 around its longitudinal axis to a first position in which webs 24*a* of levers 24 are horizontal and extend towards the exterior of plate 8 to a second position in which webs 24*a* are horizontal and extend towards the interior of the mill.

26 denotes a vertical wall or abutment for the bar, borne by a number of bearings 27 secured to plate 8 and extending parallel to direction $R_1$ of action of thrust means 20, from the side thereof opposite pivot 22. Wall 26, which has predetermined dimensions and may be positioned in accordance with a register, co-operates with levers 24 when the levers are brought into the second position, to form a cradle-like seat S extending coaxially with direction $R_1$ and adapted to receive a bar 7 in the manner described hereinafter.

Reference 28 denotes a bed-plate secured to the ground and extending parallel to axis A, substantially in line with the rolling-mill inlet side 6 and below plate 8. Bed-plate 28 substantially comprises a number of uprights 29 which project above plate 8 through corresponding transverse slots 29*a* which are formed in the plate and extend in arcs of a circle having a common centre on the vertical axis 10*a* of pivot 10. Uprights 29 are dimensioned and designed to bear a square bar 7 at the moment when it is introduced into the rolling mill through the inlet guide 6. To this end, uprights 29 cooperate with a bar guide device (general reference 30) which can be conventional. In the accompanying drawings, device 30 mainly comprises a box-like member 31 (FIG. 3) having a substantially U-shaped cross-section and parallel webs 31*a* and 31*b*, open at the bottom and extending over all the uprights 31, with which it forms a "tunnel" having the right dimensions for surrounding and suitably guiding the square bar 7. More particularly the vertical wall 31*b* of member 30, which is firmly secured by plate 8, is tiltable by an actuator 33, e.g. a hydraulic cylinder, around a pivot 32 parallel to the direction of action R of the first thrust means 14. This tilting is necessary in order laterally to insert a bar 7 into the tunnel formed by uprights 29 and device 30.

Figure 3:
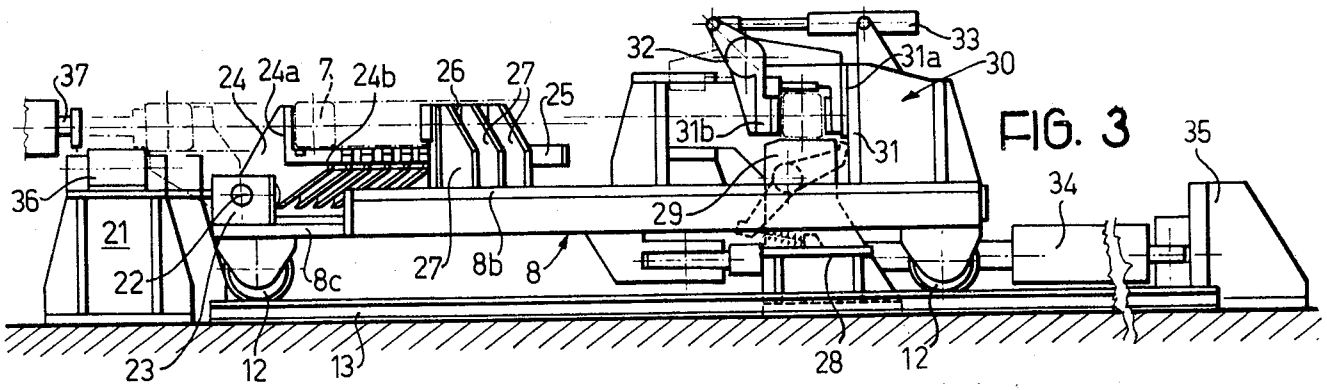
FIG. 3 is a view from X of the device illustrated in FIG. 1.

Reference 34 in FIG. 3 diagrammatically indicates a double-acting hydraulic cylinder used for rotating plate 8 around the vertical axis of pivot 10. References 35, 35*a* indicate two stop means for limiting the rotation in either direction.

In FIG. 3, reference 36 denotes a conventional roller track disposed at the side of plate 8 for supplying successive bars 7 for conveying to the PPM, using the device according to the invention. Reference 37 denotes each out of a number of thrust means used for transferring a bar 7 from the roller track 36 to the group of L-shaped levers 24 in the tilting means 21, when the levers are held in the aforementioned first position.

The device according to the invention operates as follows:

At the beginning of a working cycle, plate 8 is positioned at an angle relative to pivot 10 so that the direction of action R of thrust means 14 coincides with the rolling and drilling axis A. When plate 8 is in the lastmentioned position, the tilting means 21 is alongside and parallel to the end portion of the roller track 36, and all the levers 24 also face track 36. The vertical wall 31*b* of the bar-guiding device 30 is in the raised position.

A square bar 7 is placed on the tilting device 21 by action of the thrust means 37. Next, oleodynamic cylinder 25 rotates tilting means 21 around its longitudinal axis and bar 7 is positioned against the vertical or abutment wall 26 in axial alignment with the direction of action $R_1$ of thrust means 20.

Next, plate 8 is rotated around pivot 10 by action of oleodynamic cylinder 34 until it meets the stop means 35, in which position the direction $R_1$ coincides with the rolling and drilling axis A. At the end of the aforementioned rotation of plate 8, bar 7 is positioned on the group of uprights 29 against the vertical wall 31*a* of the bar-guiding device 30. Wall 31*b* is lowered so as to enclose bar 7 in a guide tunnel, after which thrust means 20 rapidly inserts the bar through the inlet guide 6 until it enters the inlet of the PPM rolls 2, 3. At this stage, thrust means 20 is returned to the initial position, whereupon cylinder 34 immediately rotates plate 8 to the position in which direction R coincides with axis A.

Plate 8 remains motionless while a new bar 7 is placed on the tilting means 21. Thrust means 14, via carriage 15 and rod 18, exerts the strong thrust for which it was designed, pressing bar 7 against bit 5.

After bar 7 has been converted into a round, axially bored bloom, thrust means 14 is returned to the initial position. As soon as thrust rod 18 is released from the mouth 6*a* of the inlet guide 6, cylinder 34 rotates plate 8 to the position for inserting a new bar 7, which has been placed on tilting means 21.

The main advantage of the device according to the invention is the considerable reduction in the idle time hitherto required for loading and inserting a bar into a PPM. The reasons are as follows:

(1) A square bar for rolling and simultaneously drilling in a PPM can travel through the insertion portion, as previously defined, in a relatively short time owing to the use of a thrust means 20 which is dimensioned and designed so that it can drive the bar at a considerable speed.

(2) A new square bar can be positioned along the rolling and drilling axis (A) as soon as the thrust rod 18 has disengaged from the PPM inlet guide. Consequently, in contrast with the prior art, the idle time is completely eliminated since the carriage 15 bearing and actuating the thrust rod return to its initial or remote position from the PPM so as to leave space for receiving a new square bar between the free end of the thrust rod and the mouth of the PPM inlet guide.

(3) Additional time is saved when loading a new square bar for rolling and drilling since, while a square bar is being converted into a round, axially bored bloom, a new bar is being loaded on to the rigid plate bearing the thrust means 14, 20.

Figure 4:
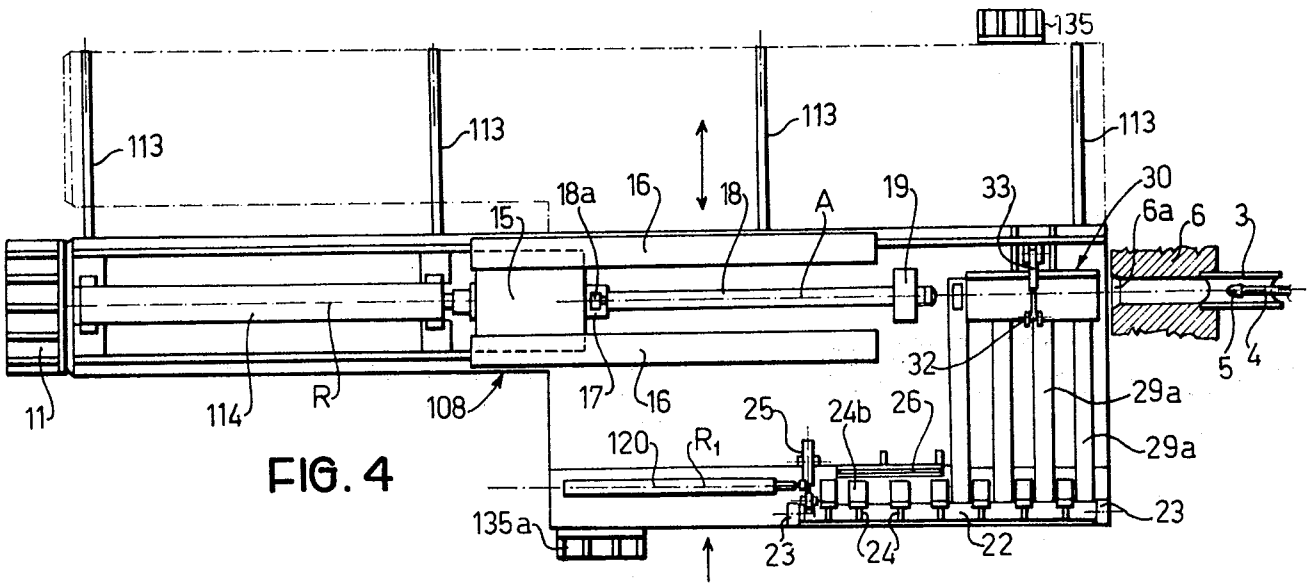
FIG. 4 is a plan view of a variant of the device in FIG. 1.

Clearly, although the previously-described embodiment of the device is preferred, numerous structural variants can be made to the device without thereby departing from the scope of the invention as defined in the claims herreinafter. In FIG. 4, for example, the movable plate is a plate 108 movably guided along a number of tracks 113 perpendicular to axis A and between two stop means 135, 135*a*. In that case the directions of action R, $R_1$ of thrust means 114, 120 will be parallel besides being in the same plane as axis A.

What is claimed is:

1. A device whereby a square bar is inserted and pushed into a press-piercing mill (PPM), the bar being disposed along the rolling and drilling axis of the mill, the apparatus being characterised in that it comprises:

a first thrust means (20) having a first direction of action ($R_1$) and thrusting the bar (7) at a speed set for introducing the bar into the press-piercing mill (PPM);

a second thrust means (14) having a second direction of action (R) and thrusting the bar (7) at a speed set for rolling and simultaneously drilling the bar (7) in the press-piercing mill (PPM), and an actuator (34) for simultaneously moving the first and second thrust means (20, 14) from a position in which the first direction of action ($R_1$) coincides with the PPM rolling axis (A) and the second direction of action (R) is at a distance from the rolling (A) to a position in which the first direction of action ($R_1$) is at a distance from the rolling axis (A) and the second direction of action (R) coincides with the axis (A) and vice versa.

2. A device according to claim 1, characterised in that the directions of action (R, $R_1$) of the thrust means (14, 20) are in the same plane and are in a predetermined spaced relationship.

3. A device according to claim 2, characterised in that the directions of action (R, $R_1$) are in the same plane as the rolling axis (A).

4. A device according to claims 1, 2, or 3, characterised in that the thrust means (14, 20) are mounted on a plate (8, 108) movably guided by the actuator (34) in a direction at an angle to the PPM rolling axis (A).

5. A device according to claim 4, characterised in that the plate (8) has one end (8*a*) pivoted around a pivot (10) having a vertical axis (10*a*) intersecting the rolling axis (A), whereas the other end of the plate is positioned near an inlet guide (6) of the PPM, the coplanar directions of action (R, $R_1$) of the thrust means (14, 20) mounted on the plate (8) forming a predetermined angle ($\alpha$) and intersecting at the point of intersection (O) between the axis (A) and the vertical axis (10*a*) of the pivot (10), the actuator (34) being adapted to rotate the plate (8) around the vertical axis (10*a*) between two stop means (35, 35*a*).

6. A device according to claim 4 characterised in that the plate (108) is movably guided by the actuator (34) in a direction perpendicular to the axis (A) between two stop means (135, 135*a*) and the directions of action (R, $R_1$) of the thrust means mounted on the plate (108) are parallel and in the same plane as the axis (A).

7. A device according to claim 4 characterized in that the plate (8,108) is formed with a substantially cradle-shaped seat (S) extending coaxially to the direction of action ($R_1$) between the second thrust means and that end of the plate (8, 108) which is near a PPM inlet guide (6).

* * * * *